US005199610A

United States Patent [19]

Gagliardi

[11] Patent Number: 5,199,610

[45] Date of Patent: Apr. 6, 1993

[54] MOTORIZED TOOTH-PASTE DISPENSER

[76] Inventor: Mario Gagliardi, 256 Main Street North, Brampton, Ontario, Canada, L6V 1P4

[21] Appl. No.: 350,459

[22] Filed: May 11, 1989

[51] Int. Cl.[5] ..... B65D 35/28

[52] U.S. Cl. ..... 222/101; 222/93; 222/105; 222/333

[58] Field of Search ..... 222/93, 96, 101, 102, 222/105, 106, 333

[56] References Cited

U.S. PATENT DOCUMENTS

| | | | |
|---|---|---|---|
| 1,352,425 | 9/1920 | Boye | 222/101 |
| 1,556,437 | 10/1925 | Granger | 222/101 |
| 2,528,662 | 11/1950 | Miller | 222/101 |
| 2,545,342 | 3/1951 | Choquette | 222/101 |
| 2,643,795 | 6/1953 | Teal | 222/101 X |
| 3,151,616 | 10/1964 | Selfon | 222/102 X |
| 3,198,389 | 8/1965 | Dunning | 222/102 X |
| 3,313,454 | 4/1967 | Welsh et al. | 222/102 |
| 3,336,925 | 8/1967 | Thompson | 222/333 X |
| 3,738,533 | 6/1973 | Bertrand | 222/102 |
| 3,860,147 | 1/1975 | Vessio et al. | 222/96 |
| 3,946,904 | 3/1976 | Mulakala | 222/102 |
| 4,234,104 | 11/1980 | Apuzzo, Jr. et al. | 222/101 X |
| 4,258,864 | 3/1981 | Karamanolis et al. | 222/101 X |
| 4,403,714 | 9/1983 | Kane | 222/101 |
| 4,508,242 | 4/1985 | Wolfe | 222/102 |

FOREIGN PATENT DOCUMENTS

| | | | |
|---|---|---|---|
| 1036100 | 9/1953 | France | 222/101 |
| 2005595 | 12/1969 | France | 222/101 |
| 2415584 | 9/1979 | France | 222/102 |

*Primary Examiner*—Kevin P. Shaver

[57] ABSTRACT

This invention relates to a device for dispensing toothpaste from a collapsible tube. A housing having a dispensing aperture, structure for retaining the container within the housing, rack and pinion structure disposed within the housing. The pinion is displaceable relative to the rack so as to squeeze the tube and force the toothpaste through the dispensing aperture of the housing when the electric motor is activated. A switch is provided for activating the electric motor.

15 Claims, 12 Drawing Sheets

MOTORIZED TOOTH-PASTE DISPENSER

FIELD OF INVENTION

This invention relates to a device for dispensing material from a collapsible container and in particular relates to a device for dispensing toothpaste from a toothpaste tube.

BACKGROUND TO INVENTION

Various products have heretofore been constructed with the purpose of dispensing materials from a collapsible container. Such products include collapsible tubes such as toothpaste tubes which contain toothpaste which is adapted to be squeezed out of the collapsible tube by hand to be discharged onto a toothbrush.

Various disadvantages have been observed with regard to manually squeezing toothpaste from a collapsible tube in that the tube sometimes becomes badly twisted so as to make it difficult to squeeze the maximum amount of toothpaste out of said collapsible tube. Furthermore, the tube sometimes becomes cracked and the toothpaste oozes out of the collapsible tube. Furthermore, some individuals find the overall appearance of such manually squeezed collapsible tube as aesthetically unappealing.

Accordingly, various devices have heretofore been constructed in order to overcome some of the difficulties referred to above.

For example, U.S. Pat. No. 4,234,104 discloses apparatus for dispensing paste from a collapsible tube whereby the apparatus comprises a case having an electric motor enclosed therein which when activated moves a pair of rollers downwardly on both sides of the tube and thereby force paste therefrom.

Furthermore, U.S. Pat. No. 3,417,902 shows the use of two racks with a single tooth roller for dispensing paste from a collapsible tube.

Moreover, U.S. Pat. No. 1,352,425 illustrates the use of a pair of rack and pinion gears in a dispensing apparatus.

U.S. Pat. No. 1,492,534 illustrates a toothpaste holder utilizing a roller having a pair of spaced projections adapted to engage with the plurality of spaced apertures.

Dispensing devices for collapsible tubes are also shown in U.S. Pat. No. 1,924,195 which particularly shows the use of a pair of rack and pinion gears.

Finally, U.S. Pat. No. 2,168,080 illustrates a collapsible tube dispenser utilizing a pair of rack and pinion gears.

Each of the various devices referred to above illustrate a relatively complicated device which is difficult to construct and assemble.

It is an object of this invention to provide an improved dispensing apparatus for dispensing materials from a collapsible container which is simpler to construct and having improved utility.

The broadest aspect of this invention relates to a device for dispensing material from a collapsible container comprising: a housing having a dispensing aperture; structure for retaining said container within said housing; rack and pinion structure disposed within said housing wherein said pinion is displaceable relative said rack so as to squeeze said container and force said material from said container through said dispensing aperture of said housing; a displaceable electric motor associated with said pinion for displacing said pinion with said electric motor relative said rack so as to squeeze said container and force said material from said container through said dispensing aperture of said housing, when said electric motor is activated; and a switch for activating said electric motor.

It is another aspect of this invention to provide a device for dispensing toothpaste from a collapsible tube comprising: a housing having a dispensing aperture and a slidable cover adapted to open and close entry into said housing; structure for retaining said tube within said housing; spaced first and second racks fixedly secured interiorally of said housing; a shaft extending between said first and second rack; first and second gears coaxially fixedly secured to said shaft and engagable with said first and second racks respectively for displacement along said racks; a roller gear coaxially secured to said shaft between said first and second gear for squeezing said tube and forcing said toothpaste from said tube through said dispensing aperture; a displaceable electric motor fixedly secured to one end of said shaft for rotating said shaft and said first and second gear when said electric motor is energized so as to displace s id first and second gear relative said first and second rack respectively and displace said roller gear relative said tube and force said toothpaste from said tube through said dispensing aperture, said electric motor displaceable with said first and second gear; and a switch for activating said electric motor.

DRAWINGS

These and other objects and features shall now be described in relation to the following drawings.

DESCRIPTION OF THE INVENTION

Like parts shall have like numbers throughout the figures.

Figure 1:
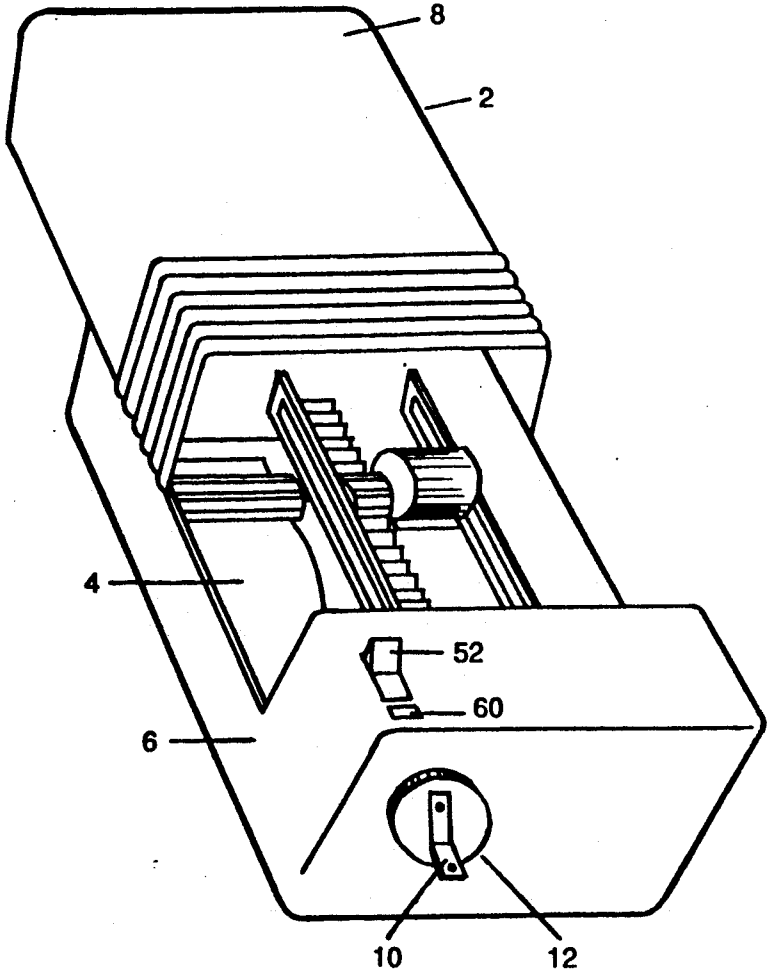
FIG. 1 is a perspective view of said toothpaste dispenser with sliding cover in the open position.

FIG. 1 is a perspective view of the device 2 for dispensing material from a collapsible container 4 which in the embodiment illustrated in the figures consist of a toothpaste tube. The device 2 consists of a housing 6 and cover 8 which is adapted to open and close entry into the housing 6. The cover 8 is adapted for slidable movement relative said housing 6.

The housing 6 includes a dispensing aperture 10 and a closure means 12 which consists of a hinged swingable closure adapted to close the opening into dispensing aperture 10.

Figure 2:
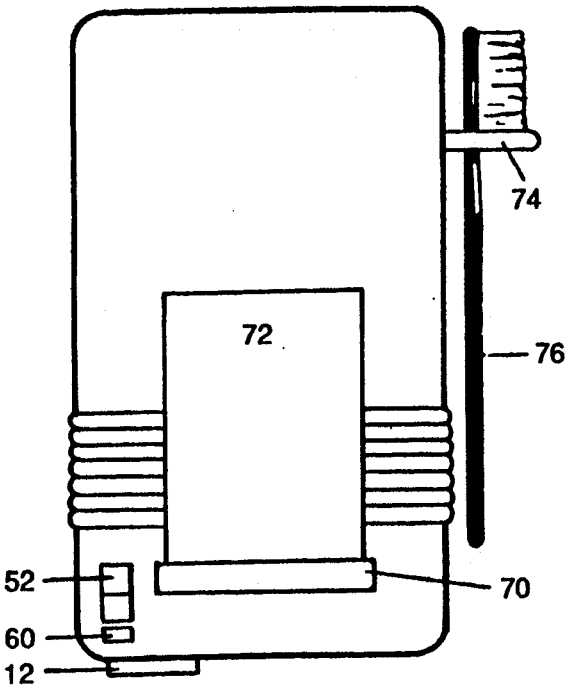
FIG. 2 is a front elevational view of said toothpaste dispenser with the sliding cover in the closed position and including a holder for glass and toothpaste brush.
Figure 3:
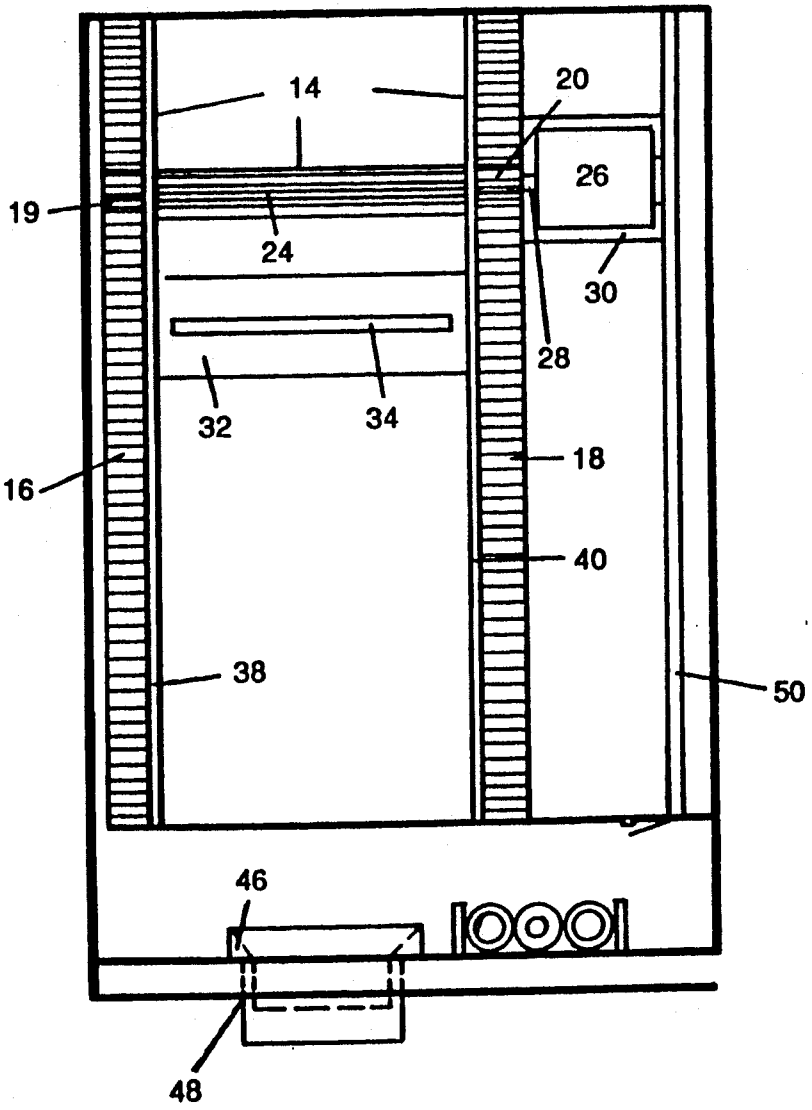
FIG. 3 is a top plan view of said toothpaste dispenser.
Figure 4:
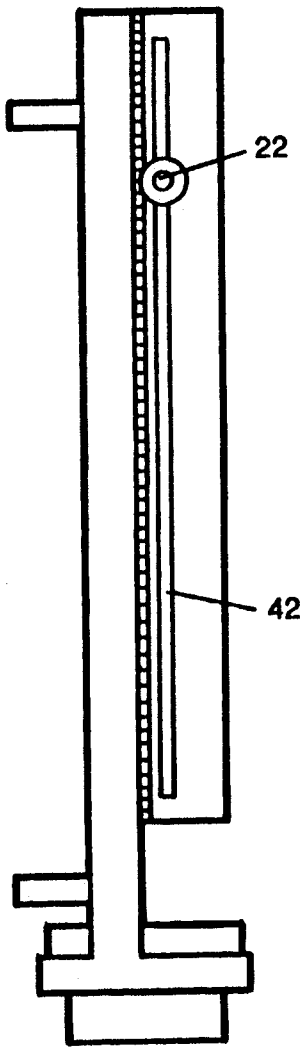
FIG. 4 is a side elevational view of said toothpaste dispenser.

A rack and pinion structure 14 is disposed within or interiorally of the housing 4 and consists of spaced first and second racks 16 and 18 respectively, first and second pinions 19 and 20 adapted for engagement with said first and second rack 16 and 18 respectively for displaceable movement relative said racks 16 and 18 in a manner to be more fully described herein. The rack and pinion structure also includes a shaft 22 which is disposed between said first and second racks 16 and 18 as illustrated in FIG. 3. Pinions 19 and 20 which comprise of tooth gears are coaxially fixedly secured to the shaft 22. A roller gear 24 is coaxially secured to shaft 22 between first and second pinions 19 and 20 as illustrated in FIG. 2. Roller gear 24 may either be fixedly secured to shaft 22 or adapted for free rotation about shaft 22.

The device 2 also includes an electric motor means 26 which is fixedly secured to one end 28 of shaft 22. The electric motor means 26 as illustrated in FIG. 3 comprises a bi-directional motor which is fixedly secured to a sliding plate 30.

Housing 2 also includes means for retaining the collapsible container 4 and as illustrated comprises a sliding plate 32 which includes an elongated slot 34 for receiving the flat end 36 of a collapsible toothpaste tube 4.

The housing includes rack and pinion mounting brackets 38 and 40 which each include a slot 42 which is adapted to receive and retain shaft 22 for slidable movement or displacement therealong. More particularly, the mounting brackets 38 and 40 ensure that pinions 19 and 20 are maintained in engagement with first and second racks 16 and 18.

Figure 5:
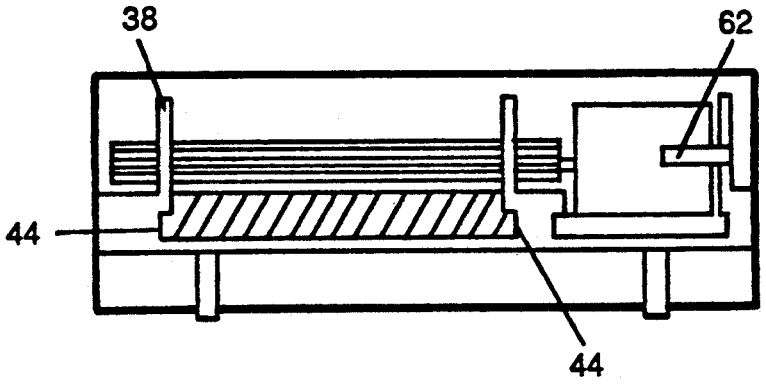
FIG. 5 is a bottom side elevational view of said toothpaste dispenser.
Figure 6:
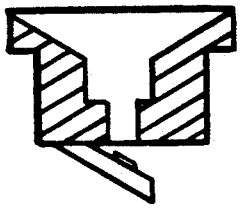
FIG. 6 illustrates the toothpaste tube insert.

The sliding plate 32 includes shoulders 44 illustrated in FIG. 5 which are adapted to lockingly engage with brackets 38 and 40. In other words the sliding plate is adapted for sliding movement relative said brackets 38 and 40 so as to adjust to any length of collapsible tube 4 which is utilized. Once the plate 32 is properly adjusted to the length of collapsible tube 4 and 36 of collapsible tube 4 is inserted into slot 34 and the other end of the collapsible tube 4 (not shown) is inserted into the toothpaste insert 46 which is adapted to hold the open end of the toothpaste tube 4. The insert 46 is adapted to be inserted into an appropriate hole 48 located in housing 6. Furthermore, the insert 46 includes a dispensing aperture 10 as well as a closure member 12 as described above.

It should be apparent that the first and second pinions 19 and 20 as well as roller gear 24 will be positioned near the top of the dispenser 2 as illustrated in FIG. 3 so as to permit easy manipulation of the sliding plate 32 and the easy insertion of toothpaste tube 4 into the housing and into sliding plate 32 and insert 46 without interference from the first and second pinions 18 and 20 and roller gear 24.

Furthermore, electric motor 26 is fixedly secured to sliding plate 30 which is restrained by bracket 40 and motor bracket 50 as best illustrated in FIG. 5. Sliding plate 30 is restrained by bracket 40 and 50 for slidable movement relative rack 18 in a manner to be more fully particularized below.

Figure 7:
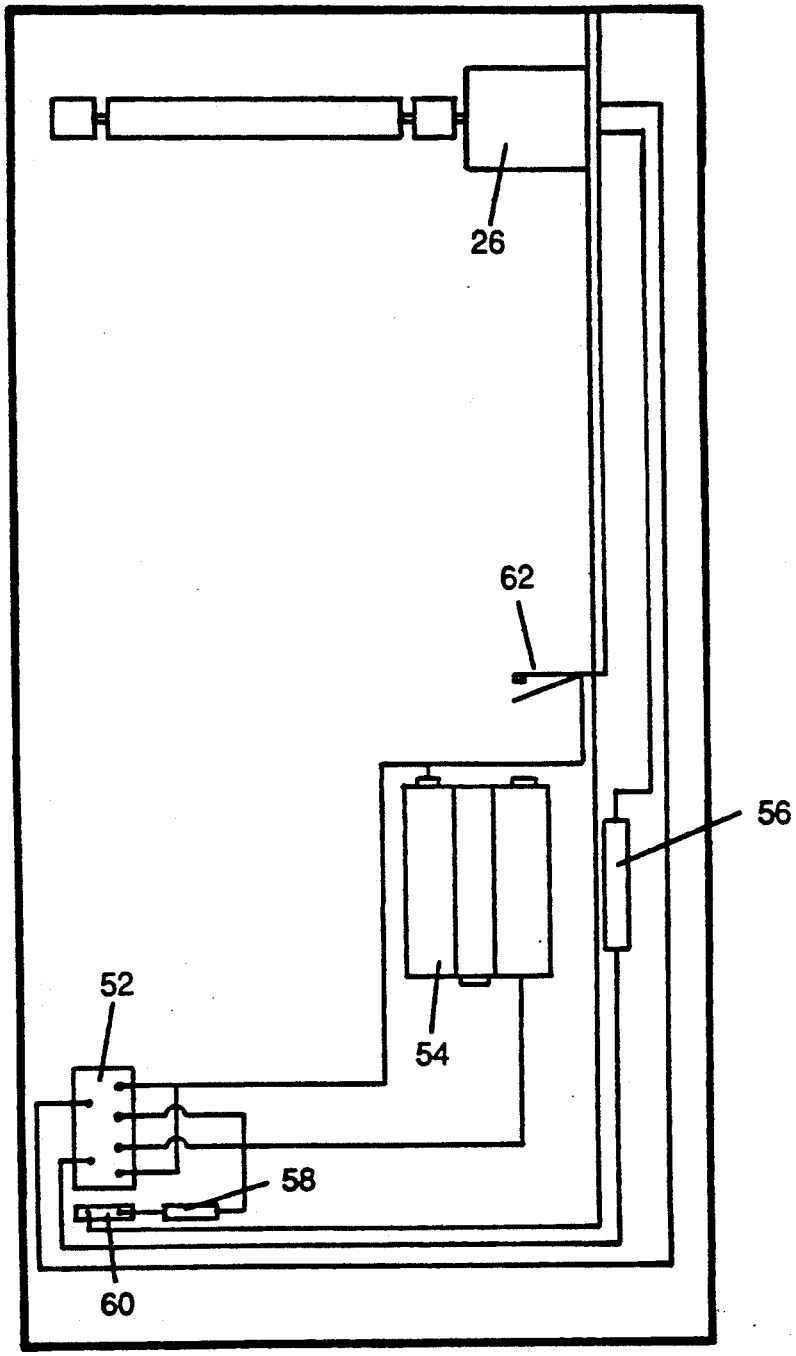
FIG. 7 is a top view of said dispenser showing the wiring diagram.

FIG. 7 illustrates the wiring diagram of the device 2 and shows the use of a double pole double throw switch 52 which is electrically connected to a power source comprising of batteries 54. The double pole double throw switch is electrically connected to the electric motor 26 through a power resister 56 which is utilized to limit the speed of the electrical motor 26. The double pole double throw switch 52 is also connected to resister 58 and a light source comprising of LED 60 connected in series to a reed switch 62. The reed switch 62 is activated when the electrical motor 26 is in the lower most position so as to cause the LED 60 to light up and signal that the collapsible toothpaste tube is substantially empty requiring replacement.

Figure 8:
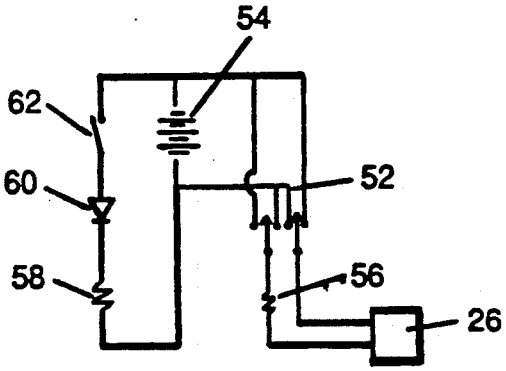
FIG. 8 is a electric schematic view of the toothpaste dispenser.

FIG. 8 is an electrical schematic diagram of the wiring diagram shown in FIG. 7.

The operation of the device shall now be described.

The collapsible toothpaste tube is inserted into housing 6 when the electrical motor 26 and first and second pinions 18 and 20 are in the upper most position as shown in FIG. 3.

In order to activate the device 2 so as to dispense toothpaste from toothpaste tube 4 the user would depress double pole double throw switch 52 so as to cause the motor to energize first an second pinions 19 and 20 to be moved or displaced downwardly along first and second racks 16 and 18 so as to cause the roller gear 24 to engage with the collapsible tube 4. Upon further activation of switch 52 roller 24 squeezes the outside of collapsible tube 4 as illustrated in FIG. 1 so as to cause the toothpaste to be forced out of the collapsible tube through insert 46 and out dispensing aperture 10. Once the appropriate amount of toothpaste has been dispensed the user would remove their finger from switch 52 thereby causing the motor to stop, and therefore stopping the toothpaste from being dispensed from the device 2.

As first and second pinions 19 and 20 engage first and second racks 16 and 18 the electric motor 26 moves or is displaced along with same by the action of the sliding plate 30 sliding between the brackets 40 and 50 relative housing 6.

When the toothpaste tube 4 is substantially empty the electric motor 26 will be in the lower most position and trip reed switch 62 thereby activating the LED 60 signal. This will inform the user that the toothpaste tube 4 should be removed and replaced. In order to replace the toothpaste tube 4 the user activates the double pole double throw switch 52 thereby causing the first and second pinions 19 and 20 to travel upwardly along rack 16 and 18 with electric motor 26. It should be noted that the direction of travel of pinions 19 and 20 relative first and second racks 16 and 18 respectively may be selected depending on whether or not the double pole double throw switch 52 is depressed in the upwardly or loweredly position.

It should be noted that the device 2 illustrated herein may be secured to a wall in the bathroom or the like by adhesives or other suitable fasteners such as screws or the like (which have not been shown). Furthermore, the device 2 may include a tray 70 adapted to hold a glass or cup 72. Furthermore, the device 2 may include a holder 74 for a toothbrush 76 as illustrated in FIG. 2.

Moreover, the device 2 may be adapted to contain tubes of cold cream or the like. Furthermore, the device 2 may be modified so as to contain more than one tube of material which would be activated by separate electric motors 26 and double throw switches 52.

Figure 9:
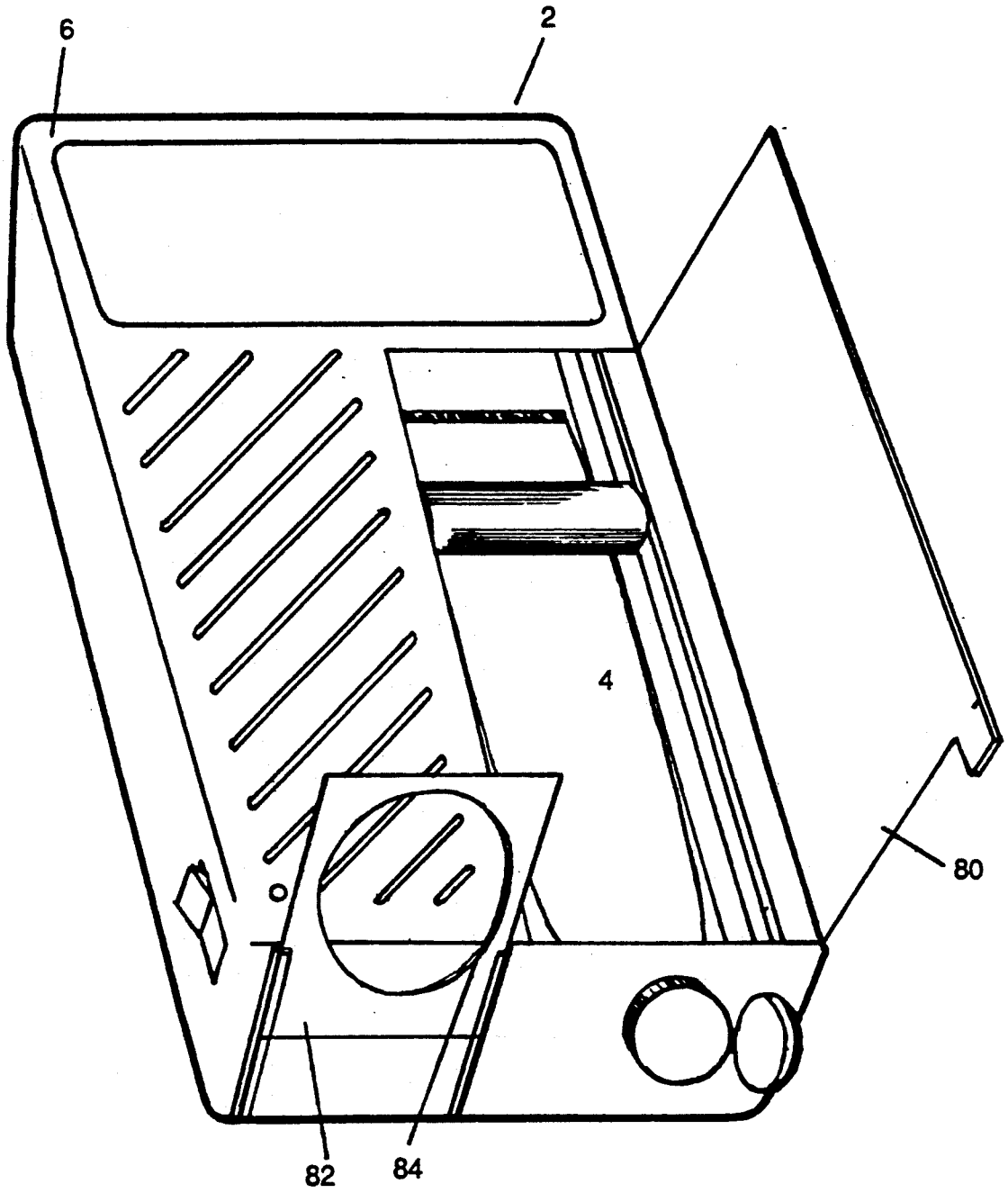
FIG. 9 is a perspective view of a second embodiment of the toothpaste dispenser with a hinged cover in the open position.
Figure 11:
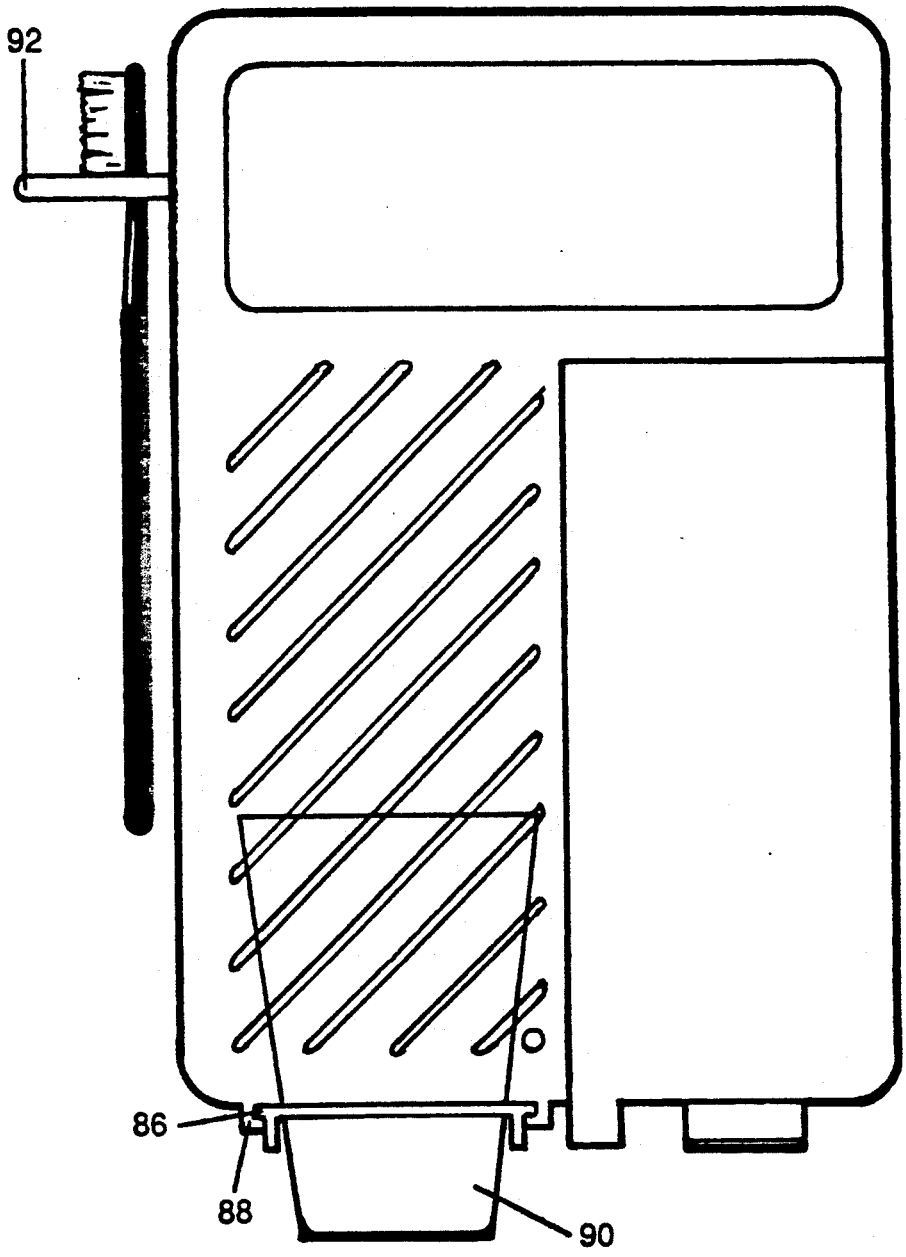
FIG. 11 is a front elevational view of the second embodiment of the invention.

FIG. 9 discloses a second embodiment of the invention whereby the cove 80 is adapted for swingable movement relative said housing 6. The embodiment disclosed in FIG. 9 also includes a sliding tray 82 having aperture 84 adapted to receive a cup or the like as best illustrated in FIG. 11. The sliding tray 82 is adapted to slide within channels 86 presented by flanges 88 as best illustrated in FIG. 11.

Figure 10:
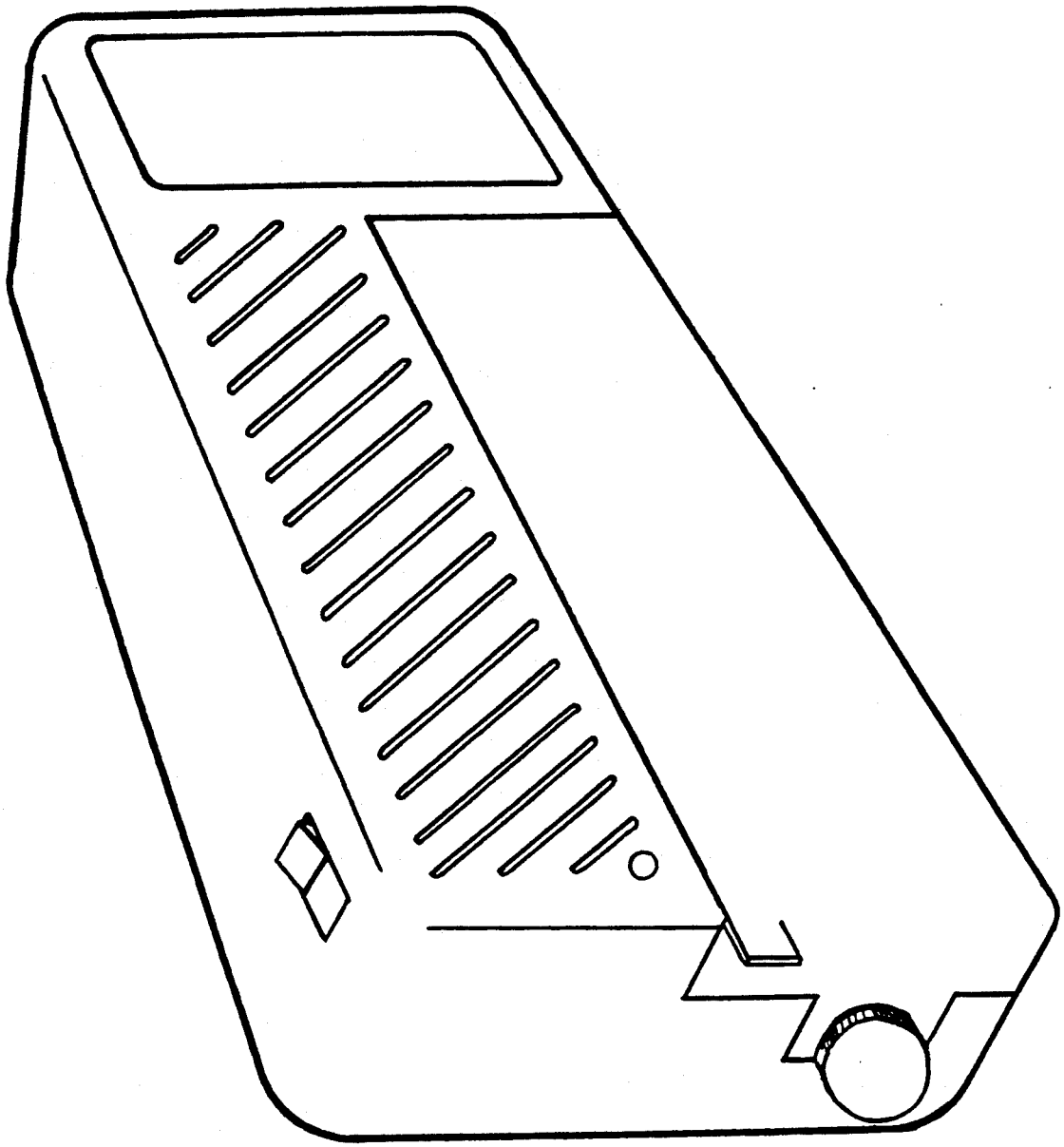
FIG. 10 is a perspective view of a second embodiment of the toothpaste dispenser with the hinged cover in the closed position.

The operation of the toothpaste dispenser 2 as illustrated in FIGS. 9, 10 and 11 shall now be described. The cover 80 is hingedly opened as illustrate in FIG. 9 and the toothpaste tube 4 is inserted into the device 2. Thereafter the cover 80 is closed as illustrated in FIG. 10.

The tray 82 may be pulled out of brackets 88 so as to place a cup 90 into the aperture 84 as best illustrated in FIG. 11.

Figure 12:
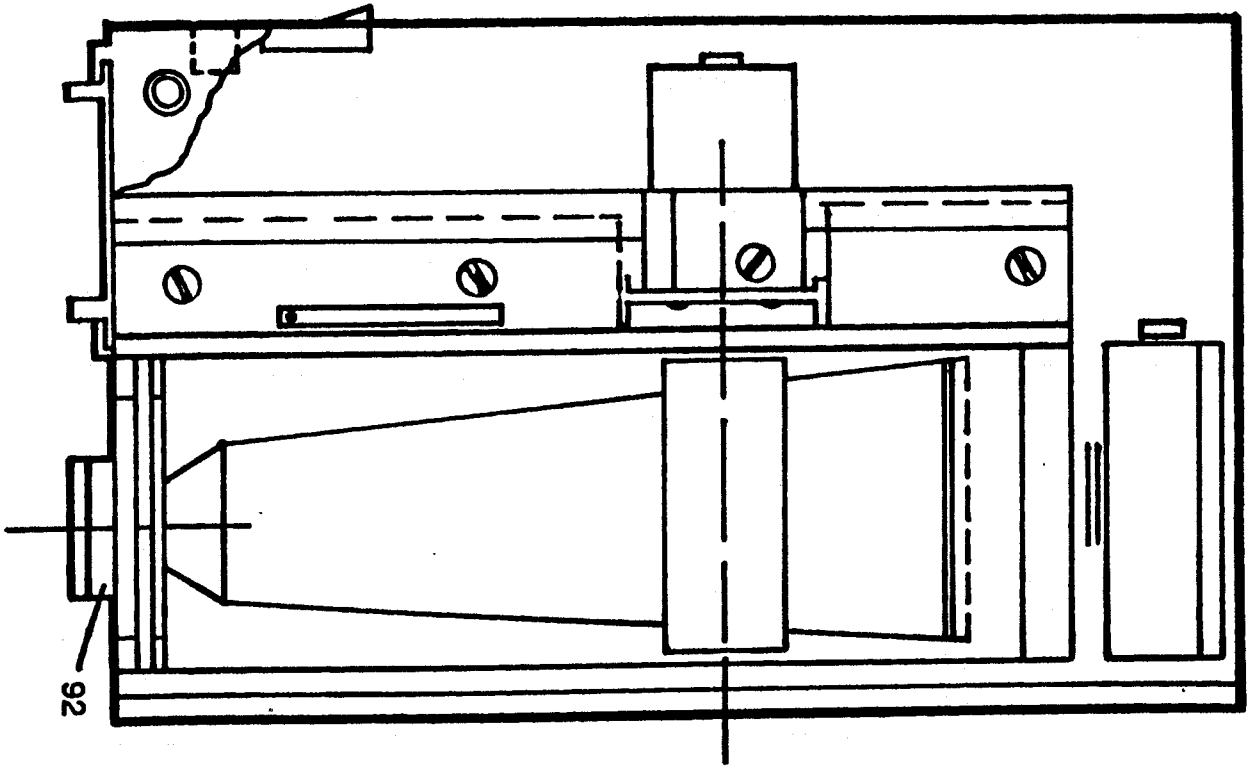
FIG. 12 is a front elevational view of the second embodiment of the invention showing the interior of the toothpaste dispenser.

FIG. 12 illustrates the interior of the second embodiment of the invention. The internal mechanism illustrated in FIG. 12 is similar to that previously described.

Figure 13:
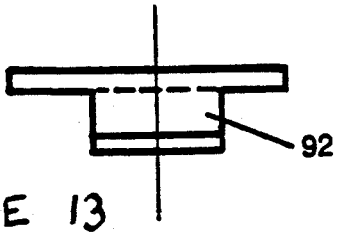
FIG. 13 is a front elevational view of a removable toothpaste tube spout.

The toothpaste dispenser 2 illustrated in FIGS. 9, 10, 11, 12 and 13 is suitable for hotel use as such device includes a removable toothpaste tube spout 92 best illustrated in FIG. 13. The toothpaste spout 92 is adapted to be removed and replaced by a new spout so a to maintain hygienic conditions for the next user.

The device disclosed in FIG. 11 may also include a toothbrush holder 92 as illustrated in FIG. 11.

Finally, FIGS. 14, 15, 16 and 17 include a third embodiment of the invention having a cover 100 adapted for swingable movement relative the housing 6. The device 2 disclosed in FIG. 14 includes toothbrush holder portion 104 and a recessed cup area or cavity 106 adapted to receive a cup or the like.

Figure 14:
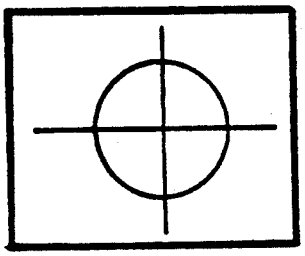
FIG. 14 is a perspective view of a third embodiment of the toothpaste dispenser.
Figure 21:
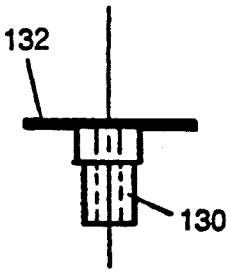
Figure 19:
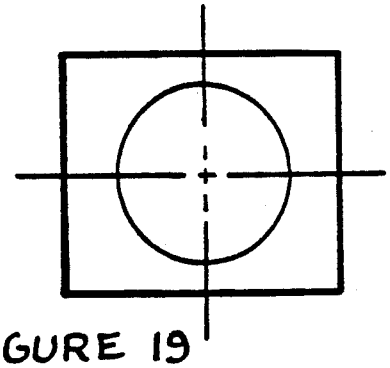
Figure 20:
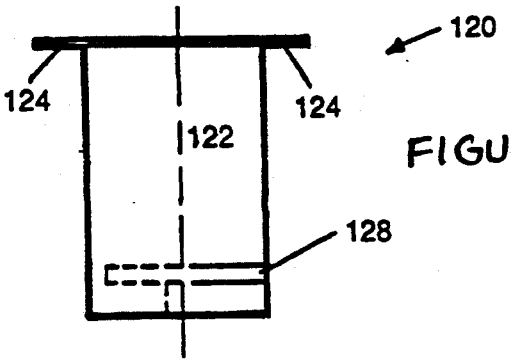

The toothpaste dispenser 2 illustrated in FIG. 14 also includes a lock 108.

Figure 17:
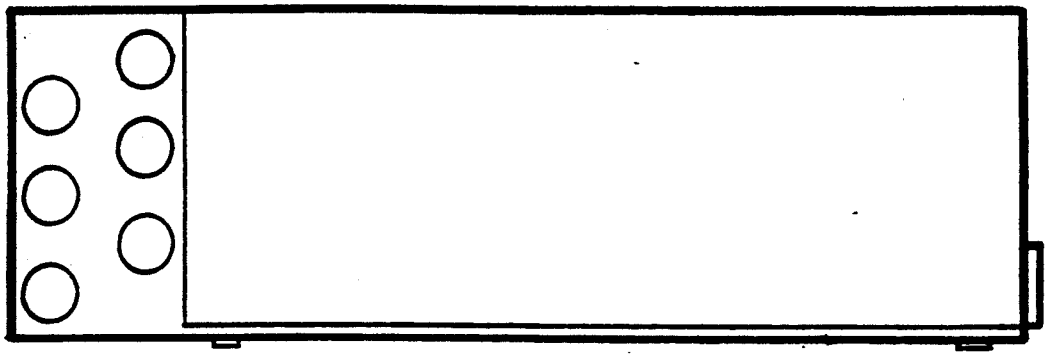
FIG. 17 is a front elevational view of the third embodiment of the invention showing the interior of the toothpaste dispenser.

FIG. 17 shows the interior of the third embodiment of the invention which discloses the use of batteries 110 micro switch 112 adapted to signal a user when the toothpaste tube 4 is empty.

Figure 15:
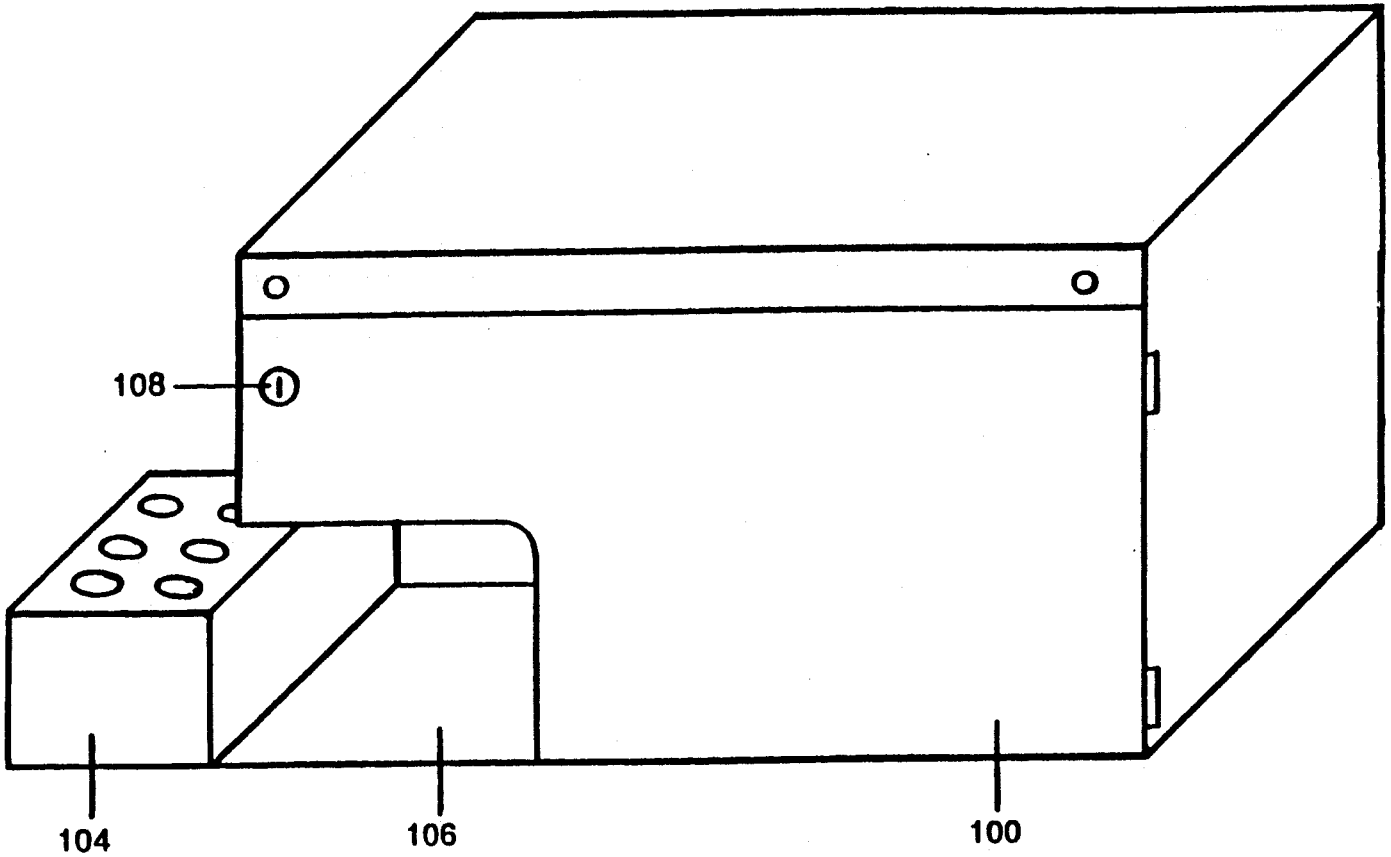
FIG. 15 is a front elevational view of the third embodiment of the toothpaste dispenser.
Figure 16:
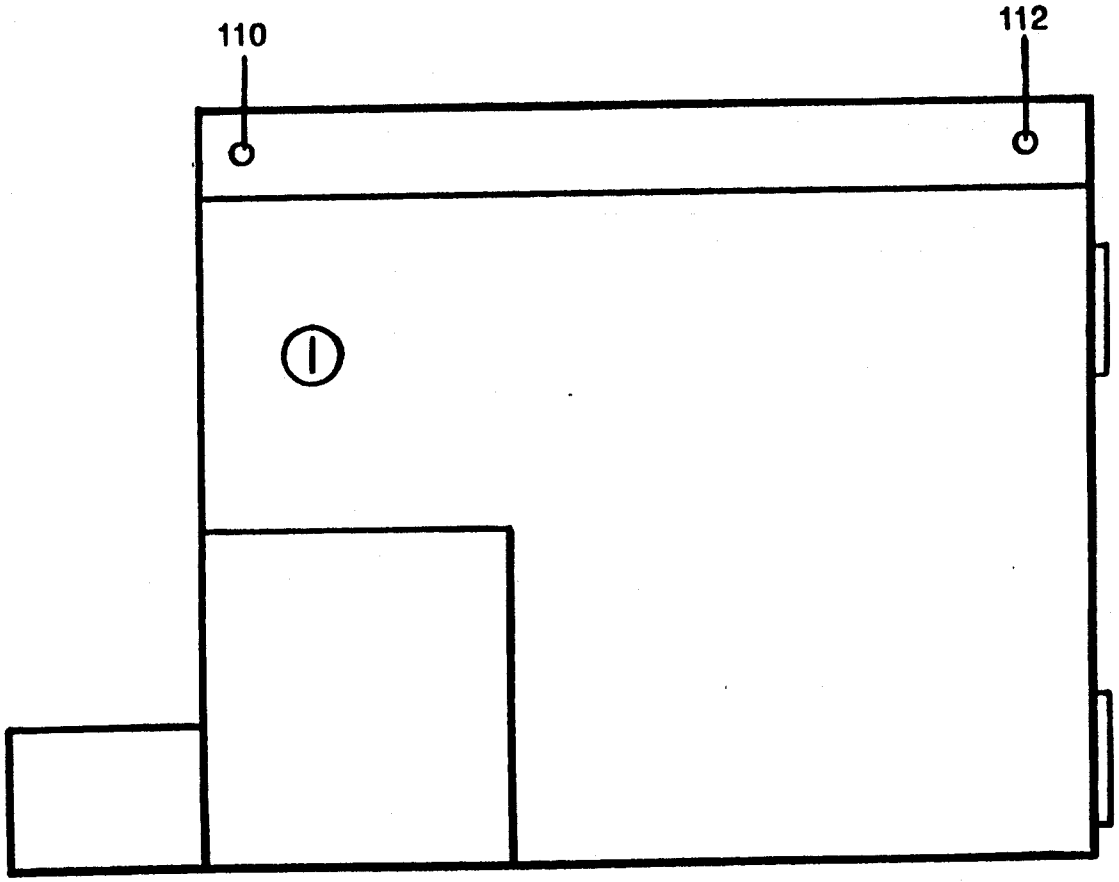
FIG. 16 is a top view of the third embodiment of the toothpaste dispenser.

Furthermore the toothpaste dispenser 2 illustrated in FIG. 15 also includes a light 110 which is adapted to signal the user when the battery 110 is on or when the batteries are being recharged. Moreover, the toothpaste dispenser 2 also includes a light 112 which signals when a toothpaste tube 4 is empty and needs to be replaced. Moreover FIG. 17 shows the use of a cylindrical roller 25 rather than the use of a roller gear 24.

Figure 18:
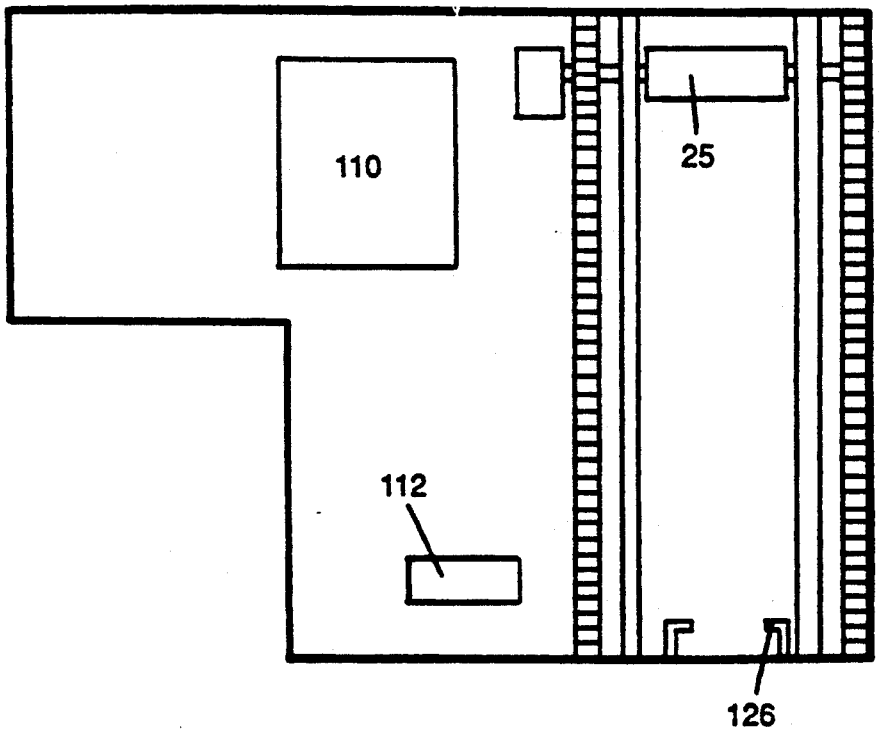
FIG. 18 is a front elevational view of a second embodiment of a toothpaste tube spout.

Finally, FIG. 18 discloses another embodiment of a toothpaste dispensing spout 120 whereby the spout body 122 includes projections 124 adapted to fit within channels 126 illustrated at FIG. 17. The spout body 122 also includes slot 128 adapted to receive spout 130 having projections 132 adapted to be inserted into the slot 128.

The operation of the rack and pinion mechanism has been described heretofore.

Although the preferred embodiment as well as the operation and use have been specifically been described in relation to the drawings, it should be understood that variations in the preferred embodiment could be achieved by a man skilled in the art without departing from the spirit of the invention. Accordingly, the invention should not be understood to be limited to the exact form revealed by the drawings.

The embodiments of the invention in which an exclusive property or privilege is claimed are defined as follows:

1. In a device for dispensing material from a collapsible container comprising:
   (a) a housing having a dispensing aperture;
   (b) means for retaining said container within said housing;
   (c) spaced first and second racks disposed within said housing;
   (d) a shaft having an axis extending from said first rack to said second rack, said shaft presenting one end extending beyond said second rack in the region remote, from said first rack;
   (e) first and second pinions coaxially fixedly secured to said shaft and engageable with said first and second racks respectively;
   (f) roller means coaxially secured to said shaft between said first and second pinion for squeezing said container and forcing said material from said container through said dispensing aperture;
   (g) a electric motor coaxially joined to said one end of said shaft adjacent said second rack in the region remote from said first rack, for displacing said first and second pinions relative to said first and second racks respectively so as to displace said roller means and squeeze said container and force said material from said container through said dispensing aperture of said housing when said electric motor is activated;
   (h) a plate secured to said electric motor, said plate being disposed substantially parallel to said axis of said shaft said plate, with said electric motor sliding relative to said housing, when said electric motor is activated,
   (i) switch means for activating said electric motor.

2. In a device as claimed in claim 1 wherein said switch means comprises a double pole double throw switch so as to activate said electric motor means in a first direction relative to said first and second racks for displacing said first and second pinions with said electric motor so as to squeeze said container, and so as to activate said electric motor in a second direction relative said racks for displacing said pinions with said electric motor opposite to said first direction.

3. In a device as claimed in claim 2 including means for indicating when substantially all of said material has been dispensed from said container.

4. In a device as claimed in claim 3 wherein said electrical motor is fixedly secured to one end of said shaft so as to rotate said shaft and said first and second pinions when said electric motor is energized so as to displace said first and second pinions relative said first and second racks respectively and displace said roller means relative to said container and force said material from said container through said dispensing aperture.

5. In a device as claimed in claim 4 wherein said dispensing aperture includes a closure.

6. In a device as claimed in claim 5 wherein said housing includes a cover.

7. In a device as claimed in claim 6 wherein said cover is swingable relative to said housing.

8. In a dispensing aperture as claimed in claim 6 wherein said device includes means for holding a glass.

9. In a device as claimed in claim 6 wherein said cover is slideable relative to said housing.

10. In a device as claimed in claim 9 including means for holding a toothbrush.

11. In a device for dispensing toothpaste from a collapsible tube comprising:

(a) a housing having a dispensing aperture and a slidable cover adapted to open and close entry into said housing;

(b) means for retaining said tube within said housing;

(c) spaced first and second racks fixedly secured interiorally of said housing;

(d) a shaft having an axis extending from said first rack to said second rack, and extending beyond said second rack in the region remote from said first rack means;

(e) first and second gears coaxially fixedly secured to said shaft means and engagable with said first and second racks respectively for displacement along said first and second racks, respectively;

(f) roller gear means coaxially secured to said shaft between said first and second gears for squeezing said tube and forcing said toothpaste from said tube through said dispensing aperture;

(g) a displaceable electric motor coaxially fixedly secured to said one end of said shaft adjacent said second rack in the region remote from said first rack, for rotating said shaft and said first and second gears when said electric motor is energized so as to displace said first and second gears relative to said first and second racks respectively, and displace said roller gear means relative to said tube and force said toothpaste from tube through said dispensing aperture, said electric motor displaceable with said first and second gear means;

(h) a plate secured to said displaceable electric motor, said plate being disposed substantially parallel to said axis of said shaft, said plate with said displaceable electric motor sliding relative to said housing when said electric motor is activated; and (i) switch means for activating said electric motor 12. In a device as claimed in claim 11 wherein said switch means includes means for activating the said displaceable electric motor means in:

(a) one direction to force toothpaste from said tube through said dispensing apparatus; and (b) in a second direction opposite to said first direction.

13. In a device as claimed in claim 12 including spaced first and second brackets disposed adjacent and generaly parallel to said first and second racks, said brackets including slot means for receiving said shaft there through for slideable movement there along during activation of said displaceable electric motor.

14. In a device as claimed in claim 13 further including: p1 (a) a motor bracket spaced from said second bracket in the region remote from said first bracket; and (b) said plate disposed between said second bracket and said motor bracket.

15. In a device as claimed in claim 12 wherein said housing includes a bottom wall and wherein said plate is disposed substantially parallel to said bottom wall for relative slideable movement therewith.

* * * * *